US011446724B2

(12) United States Patent
Codatto

(10) Patent No.: US 11,446,724 B2
(45) Date of Patent: Sep. 20, 2022

(54) RELEASE DEVICE FOR AN INDUSTRIAL MACHINE FOR THE BENDING OF METAL ELEMENTS

(71) Applicant: Bystronic Laser AG, Niederoenz (CH)

(72) Inventor: Antonio Codatto, Cologna Veneta (IT)

(73) Assignee: BYSTRONIC LASER AG, Niederoenz (CH)

( * ) Notice: Subject to any disclaimer, the term of this patent is extended or adjusted under 35 U.S.C. 154(b) by 333 days.

(21) Appl. No.: 16/721,993

(22) Filed: Dec. 20, 2019

(65) Prior Publication Data

US 2020/0222961 A1 Jul. 16, 2020

(51) Int. Cl.

| | |
|---|---|
| ***B21D 5/04*** | (2006.01) |
| ***B21D 43/26*** | (2006.01) |
| ***B25B 5/00*** | (2006.01) |
| ***B25B 5/06*** | (2006.01) |
| ***B25B 5/10*** | (2006.01) |

(52) U.S. Cl.

CPC ..... *B21D 5/04* (2013.01); *B21D 43/26* (2013.01); *B25B 5/006* (2013.01); *B25B 5/06* (2013.01); *B25B 5/061* (2013.01); *B25B 5/10* (2013.01)

(58) Field of Classification Search

CPC ..... B21D 5/04; B21D 5/047; B21D 37/14; B21D 37/04; B21D 37/06; B25B 1/02; B25B 1/06; B25B 1/10; B25B 1/103; B25B 1/013; B25B 1/12; B25B 5/145; B25B 5/16; B25B 5/166; B25B 5/02; B25B 5/085; B25B 5/087; B23Q 3/067; B23Q 3/068; B23Q 3/102; B23Q 3/107; B23Q 3/108; B23B 31/00–42

USPC ..... 269/289 R, 55, 37; 29/791, 281.1, 281.3, 29/281.5

See application file for complete search history.

(56) References Cited

FOREIGN PATENT DOCUMENTS

WO WO-2013001491 A1 * 1/2013 ..... B21D 5/047

* cited by examiner

*Primary Examiner* — Lee D Wilson
*Assistant Examiner* — Robert F Neibaur
(74) *Attorney, Agent, or Firm* — Jacob Eisenberg

(57) ABSTRACT

A release device developed for an industrial machine for the bending of metal elements via a plurality of sheet-pressing tools arranged on a support frame is disclosed. The device includes a longitudinal member whereupon the sheet-pressing tools are positioned via an inclined interface. A modular coupling interface is included and situated between the wall of the machine and tightening elements, which keeps the tools locked in position. Clamping elements are set out which are suitable for locking the interface against the upper wall of the tools and which are arranged in an alternate manner in relation to a plurality of actuators. The actuators, once actuated, exert a force against the wall that is opposite to that exerted by clamping elements, and therefore allow for the horizontal displacement of the clamping elements, such a displacement making it possible for the interface to move itself vertically in such a way as to allow for the removal of the sheet-pressing tool.

11 Claims, 5 Drawing Sheets

RELEASE DEVICE FOR AN INDUSTRIAL MACHINE FOR THE BENDING OF METAL ELEMENTS

BACKGROUND

The present disclosure relates to a release device developed for an industrial machine for the bending of metal elements (also known as an automatic bending or paneling machine). More particularly, the embodiments of the present disclosure relate to a release device for a machine of the type, typically to be used for the processing of essentially flat metal elements, such as sheets, panels and the like, in such a way as to obtain elements that are shaped according to a predetermined design.

The device confronts and solves the familiar problem of these machines, in relation to the complexity of the alignment of the various sheet-pressing elements or folding means both on the horizontal and the vertical plane.

As is known to those who are skilled in the field associated with this type of machine, it comprises a structured and complex automatic plant that, in addition to the bending station, is characterized in that sheet-pressing tools are provided for, it provides for the loading of the flat metal element to be bent, it unloads once the flat metal element has been bent and a handling assembly that is suitable for moving and rotating the flat metal element to be bent, or that has been bent, in such a way as to submit it to the specific processing sequence is also present. This type of machine generally comprises a support frame, resting on a reference surface (for example, the floor of an industrial plant), and a working-plane, connected to the support frame and accessible to the operator, whereupon the flat metal element to be processed is arranged. Furthermore, in this type of machine, bending means are provided for (comprising upper sheet-pressing tools and lower sheet-pressing tools), arranged, in relation to the working plane, in front and coupled to said support frame, also arranged in order to block the flat metal elements, in such a way as to allow a tool assembly to bend upwards and/or downwards at least one of the lateral edges of the flat element. Again in general terms, the industrial machine comprises hooking means that ensure the correct positioning and alignment of the tools during the processing step. Insofar as they have been employed for many years, it is by now a consolidated fact that industrial machines, as described above, make it possible to obtain a wide variety of folds on the flat metal element.

Those solutions that are already known and available on the market have already faced, in proposing various solutions, a problem that due to the fact that when at least one of the peripheral edges of the flat element being processed has already been bent, the upper sheet-pressing tools are in most cases not able to assume the horizontal position on the working-plane, namely the position that would be correct for a subsequent bending operation of another peripheral edge.

Despite the progress made in recent years, most known machines often fail to perform additional folds of certain types of flat metal elements that have already been folded along some of the sides, for which reason, in many cases, these folds are not performed.

SUMMARY

One proposed solution to solve the aforementioned problem of having an industrial machine that allows for folds to be performed on all four sides of the flat element, provides for the upper sheet-pressing tools to consist of a plurality of extractable and repositionable elements, so as to allow for the adaptation of the overall dimensions of the folding means themselves, combining the pressing-tools themselves in such a way as to adapt them to the space available from time to time on the flat member being processed as a result of first folds.

In summary, the flat element being processed is initially subjected to processing along a first and a second edge, one opposite the other. When processing is required along a third edge, included between the first two edges, the upper sheet-pressing tools would find an obstacle to enter into contact with the flat element, an obstacle determined by the bends that have already been performed on the first two edges. For this reason, as mentioned, with the solutions already available, the dimensions of the upper sheet-pressing tools are reduced, simply by eliminating from the processing area a series of elements, usually the central ones, in such a way that the remaining tools can be inserted into the reduced space remaining between those bends that have already been performed on the first two edges.

The above solution makes it possible to solve the aforementioned problem. However, the same solution introduces a further problem, which certainly does not make it possible to obtain clean and smooth folds, as would be required.

Indeed, one skilled in the art would easily understand how the fact that the upper sheet-pressing tools are composed of differing elements implies that when the necessary dimension of the folding means has been chosen, removing or adding elements that form the upper sheet-pressing tools, it is necessary to tighten them in order to obtain a single bending means that is aligned both in the horizontal direction and in the vertical direction, in order to obtain a clean and smooth folding of the flat element.

With industrial machines of the type described in the introductory part, this problem has not been solved, if not partially, i.e. ensuring the precise alignment in the vertical plane, but not the equally precise alignment in the horizontal plane. In particular, the upper sheet-pressing tools provide for a longitudinal element, whereto are coupled the chosen individual sheet-pressing tool elements. Once the necessary configuration has been reached, vertical tightening means are provided for on the longitudinal element, which make it possible render the individual upper sheet-pressing tools compact, aligning them in a sufficiently precise manner in the vertical direction, but not equally in the horizontal direction, insofar as said tightening means act only in the vertical direction.

In light of the foregoing, a solution has been designed and implemented that makes it possible to solve the aforementioned problem, ensuring near perfect alignment of the individual upper sheet-pressing tools both on the horizontal plane and on the vertical plane.

The solution machine provides for a plurality of sheet-pressing elements and a longitudinal member, arranged above all the elements of the plurality, and which acts upon all of the same elements of a specific configuration, chosen for the upper sheet-pressing tool; the upper sheet-pressing element provides for an interface with the longitudinal member which, in turn, provides for a transition between a plane made on the element and a plane made on the longitudinal member according to an inclined plane, from the top downwards, towards the direction of possible extraction of the element from the machine.

A plurality of horizontal tightening means is provided for on the longitudinal member that acts upon the selected elements of the upper sheet-pressing tool, the tightening means, or locking elements, by virtue of the transition to the inclined plane determining the alignment adjustment of the elements both on the horizontal plane and on the vertical plane. Additionally, the industrial machine requires the elements to be fractional and/or incremental and/or contractible elements, all having substantially the same vertical section, which can be removed or inserted from the upper sheet-pressing tool, according to necessity.

The solution proposed by the device according to the invention makes it possible, therefore, to reduce the complexity of the removal and/or insertion maneuvers of the upper sheet-pressing tools, by virtue of a series of additional elements. The elements generally comprise a coupling interface, in direct contact with the sheet-pressing-tools and arranged in an intermediate position between the upper part of said tools and the tightening means. The tightening means are held in position by a plurality of tightening screws, arranged in an alternate manner together with a series of hydraulic actuators within the tightening means. When actuated, the actuators make it possible for the tightening means to perform a horizontal displacement, in such a way as to allow the aforementioned coupling interface to translate vertically and in this way release the sheet-pressing tool, which can then be removed.

In a preferred variant, the interface is modular and comprises several identical aligned sections, in order to give the possibility, if necessary, to only remove and/or replace a certain number of sheet-pressing tools, leaving the remaining locked. Similarly, but by reversing the procedure, the locking of the inserted tools is performed. Therefore, the specific object of the present invention is a release device, for an industrial machine for bending metal elements by means of a plurality of sheet-pressing tools arranged over a supporting frame. This machine comprises a longitudinal member, to which the sheet-pressing tools are coupled by means of an inclined interface. The device comprises clamping means and a modular coupling interface, configured to be located in between the clamping means and a wall of the machine, and configured for keeping said tools in a locked position. Furthermore, the clamping means comprise a plurality of clamping elements, suitable for locking the interface to the upper surface of the sheet-pressing tools and arranged in alternation to a plurality of actuators.

According to the embodiments of the disclosure, the actuators are configured to exert on the wall, when in action, a force opposed to the force exerted by the clamping elements, therefore allowing the horizontal displacement of the clamping means and allowing the interface to move vertically to allow the removal of the sheet-pressing tools. In particular, according to the invention, the coupling interface comprises at least one plate, configured to be coupled to at least one respective sheet-pressing tool to be locked. Moreover, the clamping elements comprise clamping screws, possibly equidistant to one another. In such case, the clamping screws may be configured to be received in respective cavities within the modular interface and the industrial machine. Specifically, the actuators can be of hydraulic and/or pneumatic type. In such case, the actuators may be operated by supplying an appropriate fluid through one or more supply channels to the chambers. In addition, the release device can provide for lifting mechanisms for each of the plates of the coupling interface.

Another object of the embodiments of the present disclosure is an industrial machine for bending metal elements by means of a plurality of sheet-pressing tools arranged over a supporting frame, comprising a longitudinal member, to which the sheet-pressing tools are coupled by means of an inclined interface, and includes a release device as described above. This industrial machine can comprise a wall, suitable to keep the coupling interface locked in place when the actuators are not in action against said wall. Finally, the wall can comprise a plurality of cavities suitable to receive the respective clamping elements of the release device.

BRIEF DESCRIPTION OF THE DRAWINGS

The present invention will be now described, for illustrative but non-limiting purposes, according to a preferred embodiment thereof, with particular reference to the Figures in the accompanying drawings, characterized in that.

DETAILED DESCRIPTION

Figure 1A:
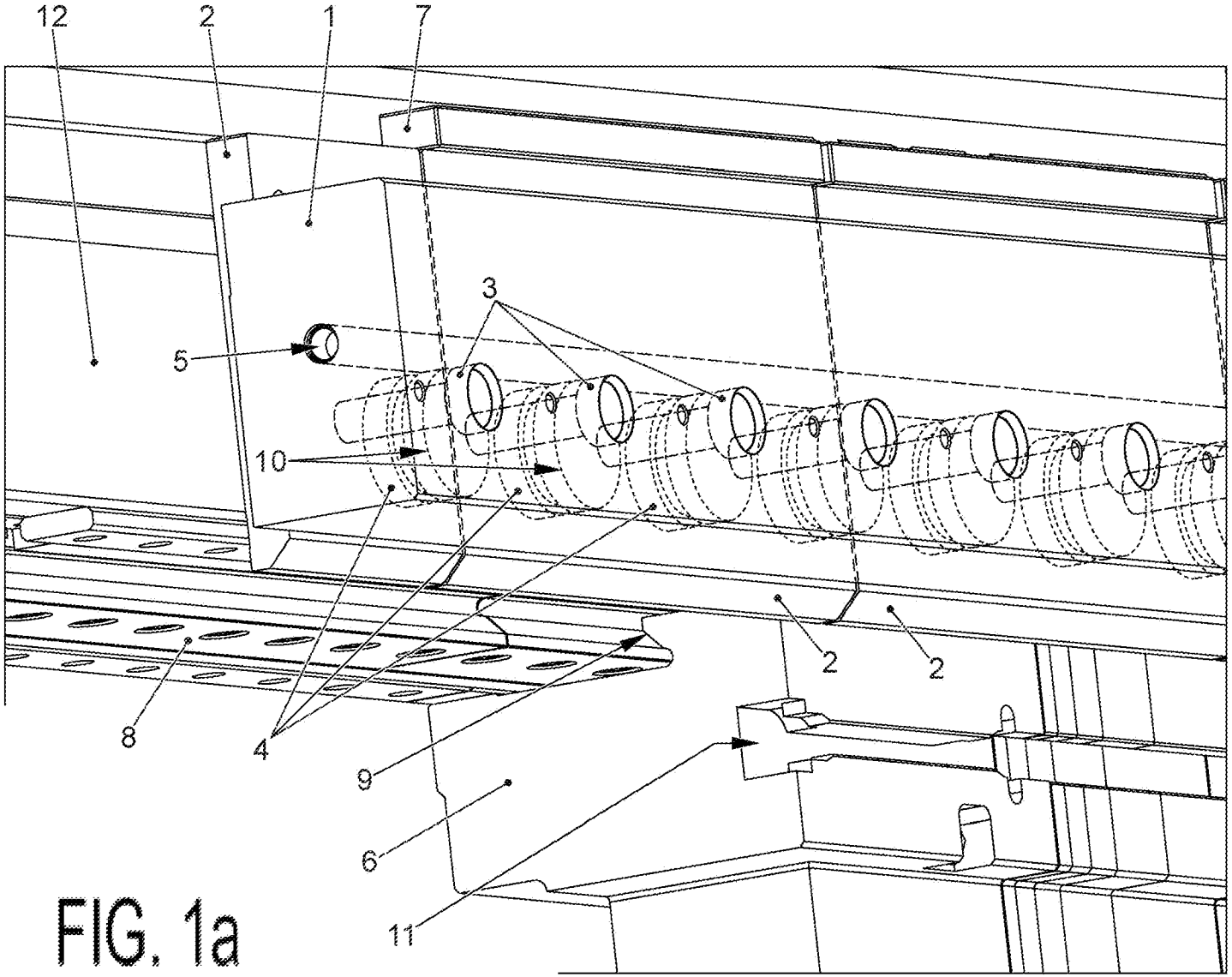
FIGS. 1*a* and 1*b* show prospective views of the elements of the industrial machine for the bending of metal elements, comprising the release device of the invention.
Figure 1B:
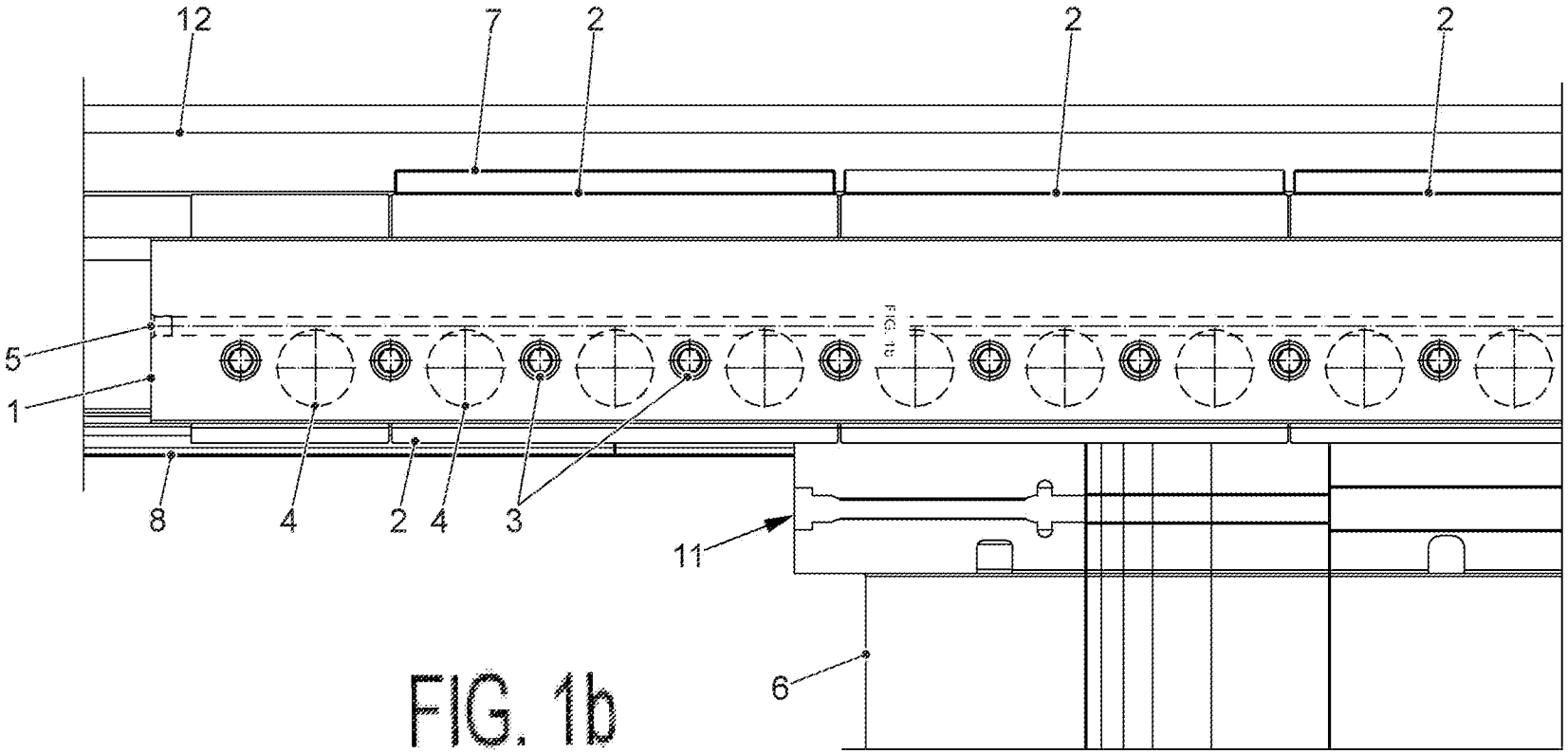
Figure 2:
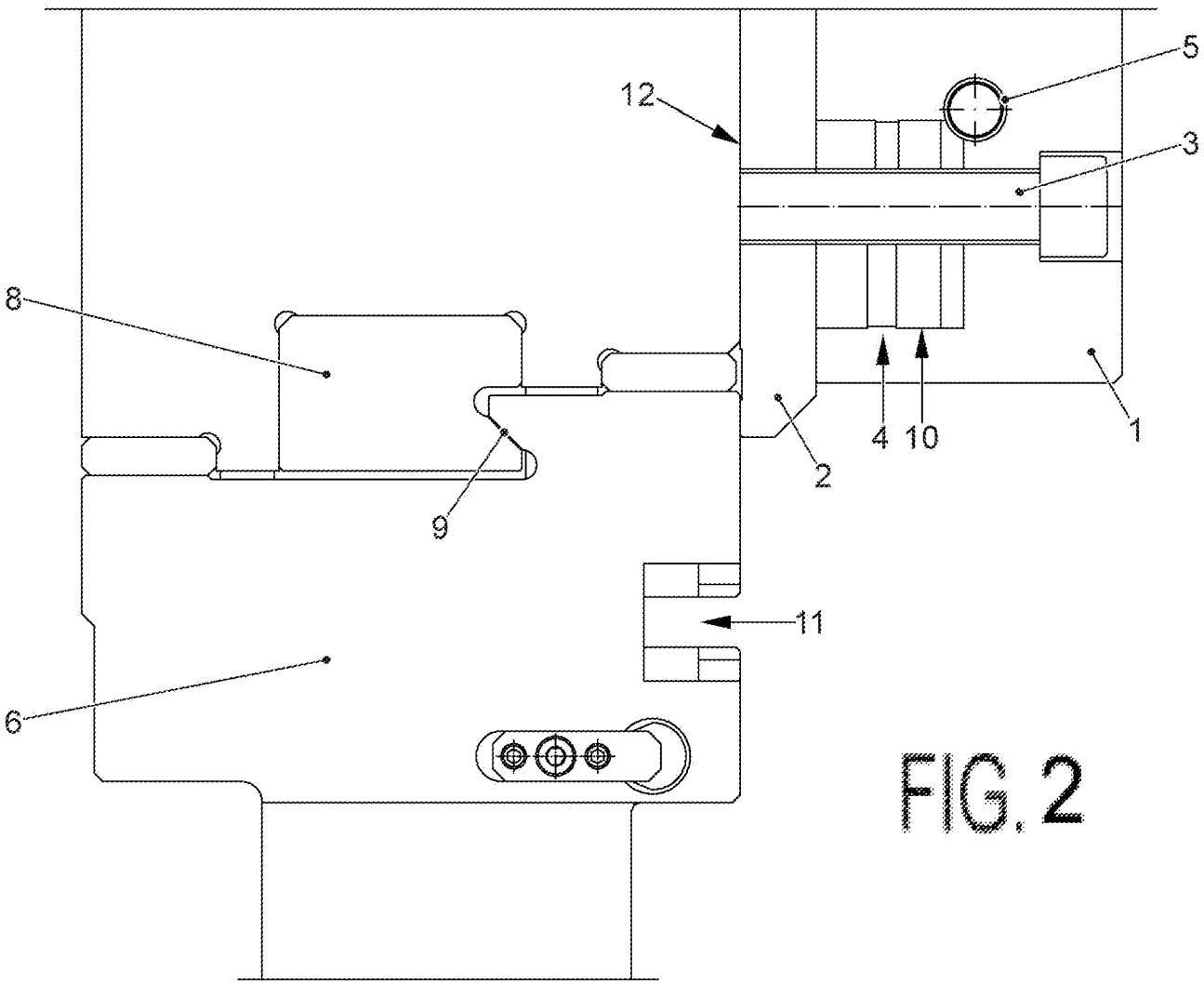
FIG. 2 shows a section along the vertical plane of the detail of FIGS. 1*a* and 1*b* in the closed position.

With reference to FIGS. 1*a* and 1*b* and 2, in general terms the following are represented: the tightening means 1, positioned on the coupling interface 2, in the closed position, with the tightening screws 3 highlighted and the actuators 4, positioned within said tightening means 1 and spaced apart in relation to the screws 3;

the supply channel 5 of the fluid of the actuators 4 and the chambers 10 thereof.

the lifting mechanism 7 of the coupling interface 2;

the wall 12 of the machine and the longitudinal member 8 whereupon, upon closing, the sheet-pressing tools 6 fit together, by means of the guidance of an inclined plane 9;

the housing 11 of the gripping means used for the removal and/or the insertion of the tools 6.

In particular, with reference to FIGS. 1*a*, 1*b* and 2, the state of the machine when the release device remains in the tightened position will now be described. The tightening means 1 is in contact with the coupling interface 2; the actuators 4 are not under pressure, therefore the tightening means 1 are maintained in position to be the tightening force exerted by the screws 3. The friction between the surfaces in contact with the interface 2 respectively with the tightening means 1 and the wall 12, therefore prevents their vertical translation and, consequently, the horizontal sliding of the tool 6 is prevented; it remains fixed to the longitudinal member 8 by virtue of the inclined plane 9.

Figure 3:
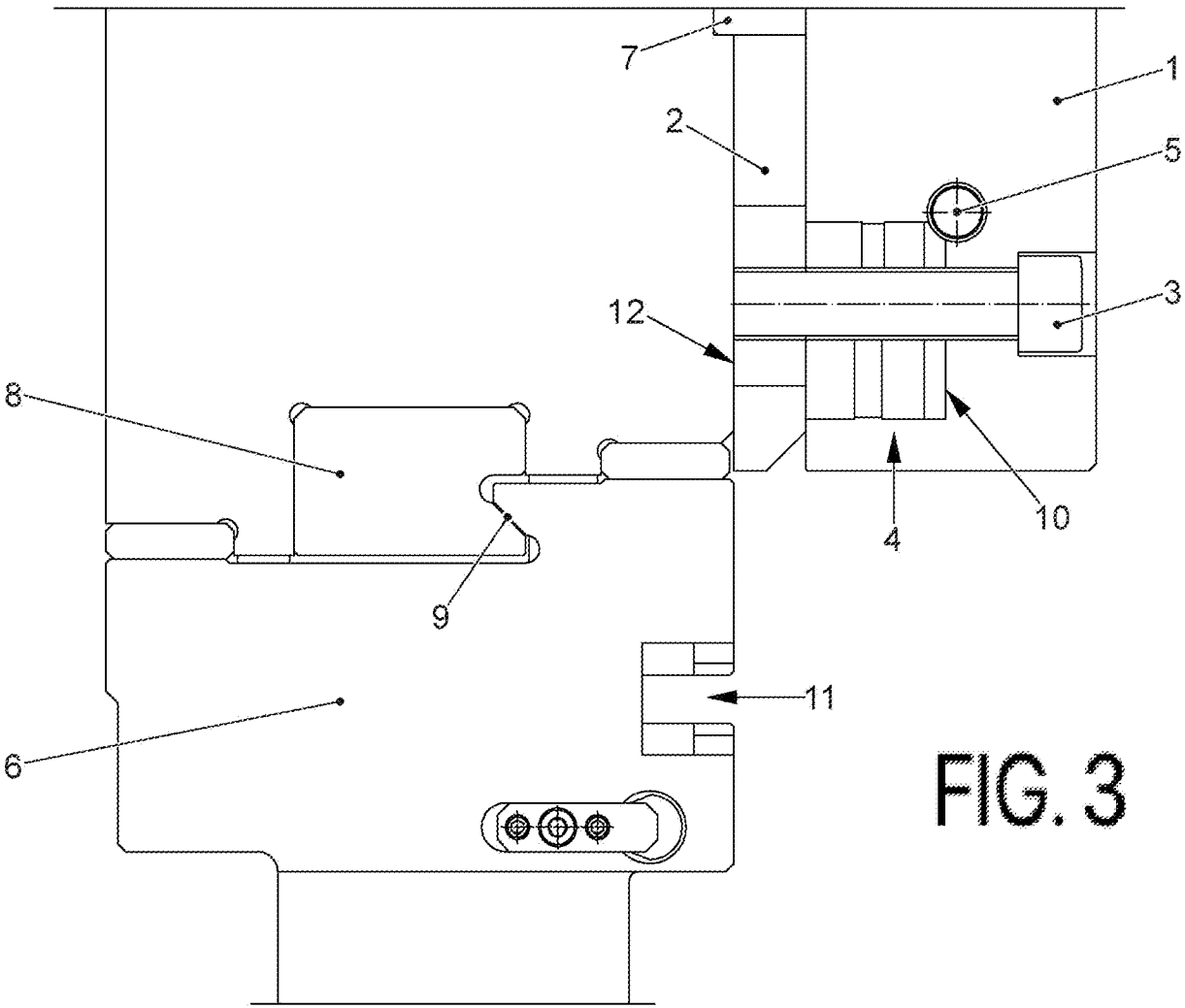
FIG. 3 shows the section of FIG. 2 in the open position.

In detail, in FIG. 3 it can be seen that the actuators 4 are in contact with the wall 12; said actuators 4 and screws 3 are positioned along a guide within the interface 2, in such a way that the interface can advantageously slide along the vertical direction. Specifically, this guide may comprise a cavity, for example passing through the interface 2 itself.

In a preferred variant, the screws 3 are preferably arranged in an alternate manner in relation to the actuators 4 but spaced apart in relation to them, in order to make it possible, upon their actuation, to obtain a minimum degree of play between the interface 2, the tightening means 1 and wall 12, freeing the tool 6, by means of a minimum displacement of the tightening means 1 along a preferred direction determined by actuators 4.

Making reference now to FIG. 3, the state of the device of the invention will be described, when the actuators 4 are actuated by the fluid supplied by the pipe 5. The increase in the pressure of the fluid within the chambers 10 generates a force that is opposed to that elastic force of the tightening exerted by the screws 3.

The consequent displacement of the tightening means 1 advantageously produces a minimum degree of play between the surfaces of the interface 2, of the tightening means 1 itself and of the wall 12, allowing said interface 2 to be lifted vertically by the mechanism 7. The tool 6 can therefore be removed and/or replaced by horizontally sliding it, by means of gripping means capable of being engaged within the housing 11.

Figure 4:
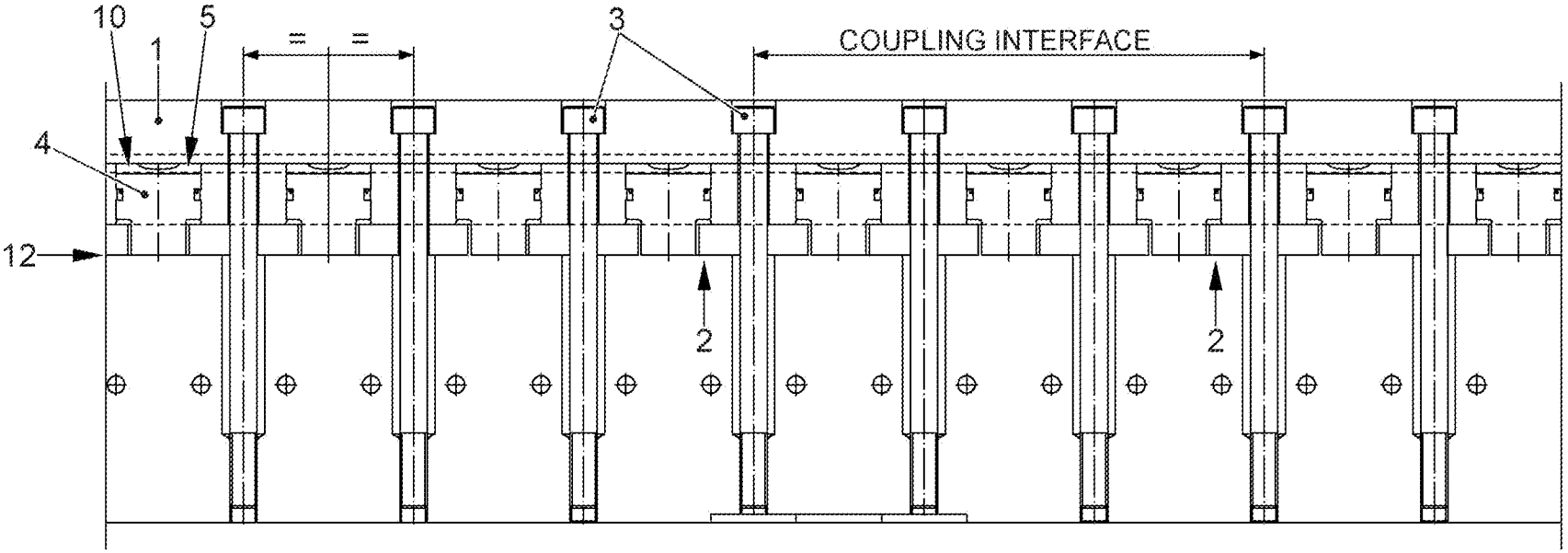
FIG. 4 shows a top view of a section of the elements of the machine.

FIG. 4 shows more clearly the arrangement of the screws 3 and of the actuators 4, in a preferred configuration, highlighting the modular character of the coupling interface 2. In general terms, it is clear that the problem mentioned above, of a quite complex nature, is resolved in a simple and ingenious manner by the device described; indeed it can, by means of a combination of simple kinematics, and some technical shrewdness, render precise, reliable and automatic a process that involves numerous drawbacks if performed conventionally, making it possible to easily and quickly take up any play between surfaces in contact.

The present invention has been described, for illustrative but non-limiting purposes, according to preferred embodiments thereof, but it is to be understood that variations and/or modifications can be made by experts in the field, without for this reason going beyond the relative scope of protection.

The invention claimed is:

1. A release device for industrial machines for bending metal elements by means of a plurality of sheet-pressing tools arranged over a supporting frame, the industrial machines comprising a longitudinal member to which said plurality of sheet-pressing tools are coupled by means of an inclined interface, said device comprising:

clamping means comprising tightening means, a modular coupling interface configured to be located in between said clamping means and a wall of the machine, said modular coupling interface being configured for keeping said plurality of sheet-pressing tools in a locked position, wherein said clamping means comprises a plurality of clamping elements suitable for locking the modular coupling interface to an upper surface of the sheet-pressing tools, and is arranged in alternation to a plurality of actuators, wherein said actuators are configured to exert on the wall, when in action, a force opposed to a force exerted by said clamping elements, facilitating horizontal displacement of the clamping means, wherein said horizontal displacement enables the modular coupling interface to move vertically to allow the removal of the sheet-pressing tool, and wherein the tightening means is configured to house the actuators.

2. The release device according to claim 1, wherein said coupling interface comprises at least one plate configured to be coupled to at least one respective sheet-pressing, of the plurality of sheet-pressing tools, to be locked.

3. The release device according to claim 1, wherein said clamping elements comprise clamping screws.

4. The release device according to claim 3, wherein said clamping screws are configured to be received in respective cavities within the said modular coupling interface and said industrial machine.

5. The release device according to claim 1, wherein said clamping elements are arranged substantially equidistant to each other.

6. The release device, according to claim 1, wherein said actuators are hydraulic and/or pneumatic actuators.

7. The release device according to claim 6, wherein the actuators comprise chambers and are operated by supplying a fluid through one or more supply channels to the chambers.

8. The release device, according to claim 1, further comprising a lifting mechanisms for each of the plates of the modular coupling interface.

9. An industrial machine for bending metal elements by means of a plurality of sheet-pressing tools arranged over a supporting frame, said industrial machine comprising:

a longitudinal member arranged to be coupled to said plurality of sheet-pressing tools by means of an inclined interface; and a release comprising:

clamping means comprising tightening means, a modular coupling interface configured to be located in between said clamping means and a wall of the machine, said modular coupling interface being configured for keeping said plurality of sheet-pressing tools in a locked position, wherein said clamping means comprises a plurality of clamping elements suitable for locking the modular coupling interface to an upper surface of the sheet-pressing tools, and is arranged in alternation to a plurality of actuators, wherein said actuators are configured to exert on the wall, when in action, a force opposed to a force exerted by said clamping elements, facilitating horizontal displacement of the clamping means, wherein said horizontal displacement enables the modular coupling interface to move vertically to allow the removal of the sheet-pressing tool, and wherein the tightening is configured to house the actuators.

10. The industrial machine according to claim 9, wherein said wall being suitable to keep said modular coupling interface locked in place when said actuators are not in action against said wall.

11. The industrial machine according to claim 10, wherein said wall comprises a plurality of cavities suitable to receive respective clamping elements of the release.

* * * * *